US007811342B1

(12) United States Patent
Hsu

(10) Patent No.: US 7,811,342 B1
(45) Date of Patent: Oct. 12, 2010

(54) COATED ABRASIVE TOOLS FROM NON-BLOCKED URETHANE PREPOLYMER

(75) Inventor: Shyiguei Hsu, McAllen, TX (US)

(73) Assignees: Saint-Gobain Abrasives, Inc., Worcester, MA (US); Saint-Gobain Abrasifs Technologie et Services, S.A.S. (FR)

( * ) Notice: Subject to any disclaimer, the term of this patent is extended or adjusted under 35 U.S.C. 154(b) by 295 days.

(21) Appl. No.: 11/371,350

(22) Filed: Mar. 8, 2006

(51) Int. Cl.
*B24B 1/00* (2006.01)
*B24D 11/00* (2006.01)
*C09K 3/14* (2006.01)

(52) U.S. Cl. ..... 51/298; 51/295; 51/297; 51/299

(58) Field of Classification Search ..... 51/298, 51/295, 297, 299
See application file for complete search history.

(56) References Cited

U.S. PATENT DOCUMENTS

| | | | | |
|---|---|---|---|---|
| 4,351,683 | A | 9/1982 | Kusilek | |
| 4,482,619 | A | 11/1984 | Bayer | |
| 4,609,380 | A | 9/1986 | Barnett et al. | |
| 4,927,431 | A | 5/1990 | Buchanan et al. | |
| 5,273,558 | A | 12/1993 | Nelson et al. | |
| 5,376,497 | A | 12/1994 | Kawata et al. | |
| 5,482,756 | A | 1/1996 | Berger et al. | |
| 5,573,844 | A | 11/1996 | Donovan et al. | |
| 5,591,239 | A | 1/1997 | Larson et al. | |
| 5,924,917 | A * | 7/1999 | Benedict et al. | 451/526 |
| 6,302,930 | B1 | 10/2001 | Lux | |
| 6,569,352 | B1 | 5/2003 | Hillshafer et al. | |
| 6,884,904 | B2 | 4/2005 | Smith et al. | |
| 6,987,160 | B2 | 1/2006 | Tanaka et al. | |
| 2002/0090891 | A1 * | 7/2002 | Adefris et al. | 451/28 |

FOREIGN PATENT DOCUMENTS

EP 0 320 146 B1 4/1996

OTHER PUBLICATIONS

Polyurethane Handbook: Chemistry-Raw Materials-Processing Application-Properties, 2nd Ed., Gunter Oertel, Hanser/Gardner Publications, Inc., 1993 (Table of Contents only).
Szycher's Handbook of Polyurethanes, Michael Szycher, CRC Press, 1999 (Table of Contents only).

* cited by examiner

*Primary Examiner*—Jerry Lorengo
*Assistant Examiner*—James E McDonough
(74) *Attorney, Agent, or Firm*—Hamilton, Brook, Smith & Reynolds, P.C.

(57) ABSTRACT

A polyurethane adhesive composition, formed by combining a non-blocked urethane prepolymer and a polymeric polyol, is used for preparing a coated abrasive tool. The polyurethane adhesive composition is applied over a substrate to thereby form a polyurethane-adhesive-composition-coated substrate. Curing the polyurethane-adhesive-composition-coated substrate forms a polyurethane-adhesive-coated substrate. An abrasive material is applied over the substrate at a time selected from the group consisting of prior to, after, and simultaneously with, the application of the polyurethane adhesive composition to the substrate, to thereby form the coated abrasive tool. The coated abrasive tool preferably includes a polyurethane adhesive resin coating over the substrate, the resin coating being formed from a polymerization reaction of a non-blocked urethane prepolymer and a phenoxy resin.

20 Claims, 2 Drawing Sheets

COATED ABRASIVE TOOLS FROM NON-BLOCKED URETHANE PREPOLYMER

BACKGROUND OF THE INVENTION

Coated abrasive tools generally include an abrasive material, typically in the form of abrasive particles, bonded to a substrate by means of one or more adhesive layers (e.g., make and/or size coat). Polyurethane adhesives have generally been employed for one or more of the adhesive layers in making coated abrasive tools. Typically, a polyurethane adhesive composition, with or without an abrasive material, is applied to a substrate. Depending upon the specific desired application, an abrasive material can be added to the polyurethane adhesive composition to form a slurry which is subsequently applied over the substrate, or alternatively can be applied separately to the polyurethane adhesive coating by gravity or by electrostatic discharge, or in an air stream.

For coating control purposes, the polyurethane adhesives are usually formulated by combining a urethane prepolymer with a curing agent in a suitable solvent. Generally, urethane prepolymers can be classified in two categories, i.e., non-blocked and blocked prepolymers. Blocked urethane prepolymers have reactive functional end groups capped with blocking group(s) to prevent premature reaction that can result in a short pot life. The blocked urethane prepolymers can provide a stable viscosity during the coating process. However, the blocking group(s) has to be removed for the urethane prepolymer to be able to react with a curing agent. Further, special tooling and processes are generally required to remove the blocking group(s) at elevated temperatures. Also, commonly used blocking agents, such as phenol or 2-butanone oxime, are generally hazardous to human beings and the environment. In addition, aromatic amines, such as methylene dianiline (MDA), 4,4'-methylene-dichloro-aniline (MOCA), which are commonly used as the curing agents for the blocked urethane prepolymers, also are generally considered to be hazardous to human beings and the environment. On the other hand, non-blocked urethane prepolymers can react with a curing agent, such as an amine as described above, too quickly, which results in rapid increase of adhesive viscosity and a shortening of the pot life of the adhesive.

Therefore, there is a need to develop new methods of preparing polyurethane adhesives for coated abrasive tools that overcome or minimize one or more of the problems discussed above.

SUMMARY OF THE INVENTION

It has now been discovered that a polyurethane adhesive composition that includes a non-blocked urethane prepolymer and a polymeric polyol, such as a phenoxy resin, as a curing agent, has a pot life long enough, and/or viscosity stable and suitable enough, for its application in preparing a coated abrasive tool. In addition, it has now been discovered that coated abrasive tools, made from such a polyurethane adhesive composition, can show superior performance in cut rates and G-ratios compared to those including a polyurethane adhesive resin made conventionally. Based upon these discoveries, a method of preparing a coated abrasive tool by the use of a polyurethane adhesive composition that includes a non-blocked urethane prepolymer and a polymeric polyol, and a coated abrasive tool made by such a method are disclosed herein.

In one embodiment, the present invention is directed to a method of preparing a coated abrasive tool. The method includes the steps of: a) combining a non-blocked urethane prepolymer and a polymeric polyol to thereby form a polyurethane adhesive composition; b) applying the polyurethane adhesive composition over a substrate to thereby form a polyurethane-adhesive-composition-coated substrate; and c) heating the polyurethane-adhesive-composition-coated substrate to thereby form a polyurethane-adhesive-coated substrate. The method further includes the step of applying an abrasive material, such as abrasive grains, particles or agglomerate thereof, over the substrate at a time selected from the group consisting of prior to, after and simultaneously with, the application of the polyurethane adhesive composition to the substrate, to thereby form the coated abrasive tool.

In another embodiment, the present invention is directed to a coated abrasive tool. The coated abrasive tool includes a substrate; a polyurethane adhesive resin coating over the substrate; and an abrasive material over the substrate. The polyurethane adhesive resin coating is formed from a polymerization reaction of a non-blocked urethane prepolymer with a phenoxy resin.

With the methods of the invention, coated abrasive tools, employing a polyurethane adhesive resin, can be prepared without the safety and environmental concerns that are typically associated with the use of blocked urethane prepolymers, as described above. In particular, in an embodiment where a phenolic resin, which is a well known resin binder in the coated abrasive tools, is employed as a curing agent, no additional, potentially hazardous curing agent is necessary, thereby minimizing or reducing safety and environmental concerns during the manufacturing processes. Also, because the methods of the invention do not employ blocked urethane prepolymers and thus do not require any special tooling and/or process to remove the blocking group(s), the manufacturing processes of coated abrasive tools by the methods of the invention can be simpler and more economic than the processes employing blocked urethane prepolymers. In addition, the coated abrasive tools of the invention, employing a polyurethane adhesive resin prepared by the methods of the invention, can show improved product performance, for example, in cutting rates and G-ratios as compared with conventional coated abrasive tools.

DETAILED DESCRIPTION OF THE INVENTION

Figure 1:
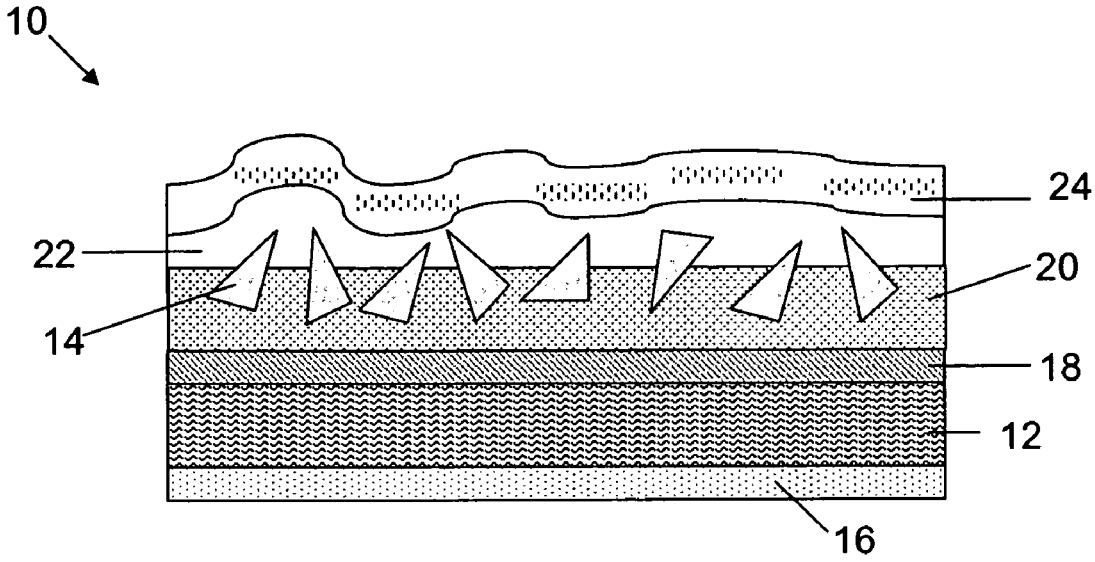
FIG. 1 is a schematic representation of a cross-sectional view of one embodiment of coated abrasive tools of the invention.

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

As used herein, the "non-blocked" urethane prepolymer refers to an urethane prepolymer where the isocyanate (—NCO) functional group(s) of the urethane prepolymer are not blocked (or protected) by any blocking (or protecting) groups.

"Urethane prepolymer," as the term is employed herein, means a molecule or macromer, such as a polymer, having isocyanate group(s) (—NCO) or functionality capable of forming an isocyanate group (—NCO). Typically, the urethane prepolymer is a non-stoichiometric reaction product of an excess of an organic isocyanate and a curing agent having two or more functional groups which can react with an isocyanate, such as hydroxyl groups (—OH), amine groups (—$NH_2$), mercapto groups (—SH) or mixtures thereof, whereby the resulting product has free isocyanate group(s). The non-blocked urethane prepolymers that can be used in the invention thus include free isocyanate group(s) that are not protected with any protecting groups. The percentage of free isocyanate groups available in the resulting isocyanate-containing prepolymer generally varies with the amount of excess organic isocyanate employed.

In one embodiment, the non-blocked urethane prepolymers employed in the invention are non-blocked, polyfunctional isocyanate prepolymers. As used herein, the "polyfunctional isocyanate prepolymer," as the term is employed herein, means a urethane prepolymer that includes multiple isocyanate groups, for example, 2, 3, 4, 5 or more. The polyfunctional isocyanate prepolymers can be substituted or unsubstituted, aliphatic, aromatic, aliphatic-aromatic (e.g., arylaliphatic), or heterocyclic prepolymers. As used herein, the term "aliphatic" includes a saturated or unsaturated, linear or cyclic aliphatic group. In a preferred embodiment, the polyfunctional isocyanate prepolymers have an average functionality of at least about 2, such as between about 2 and about 4, or between about 2 and about 2.5. In another preferred embodiment, the polyfunctional isocyanate prepolymers have a free isocyanate content of at least about 4% based on the weight of the prepolymer, such as between about 4% and about 35%, or between about 4% and about 20%.

Such urethane prepolymers can be obtained by any suitable methods known in the art. For example, the urethane prepolymers can be obtained by condensing an excess of an organic isocyanate, such as an organic diisocyanate, with a polyol having multiple hydroxyl groups, a polyamino-containing compound having multiple amine groups, or a polymercapto-containing compound having multiple mercapto groups. In one embodiment, the urethane prepolymers employed in the invention are prepared by the polymerization of an organic isocyanate with a polyol. In another embodiment, the urethane prepolymers employed in the invention are prepared by the polymerization of an organic isocyanate with a polyamino-containing compound having multiple amine groups, or a polymercapto-containing compound having multiple mercapto groups. In some embodiments, the urethane prepolymers employed in the invention can include one or more components (e.g., polymeric linkages) other than the components from the organic isocyanates and polyols, polyamino- or polymercapto-containing compounds.

Organic isocyanates useful in the invention include substituted or unsubstituted aliphatic, aromatic, aliphatic-aromatic, and heterocyclic polyisocyanates. Examples include ethylene diisocyanate, ethylidene diisocyanate, propylene diisocyanate, butylene diisocyanate, trimethylene diisocyanate, hexamethylene diisocyanate, toluene diisocyanate, cyclopentylene-1,3-diisocyanate, cyclo-hexylene-1,4-diisocyanate, cyclohexylene-1,2-diisocyanate, 4,4'-diphenylmethane diisocyanate, 2,2-diphenylpropane-4,4'-diisocyanate, xylylene diisocyanate, 1,4-naphthylene diisocyanate, 1,5-naphthylene diisocyanate, m-phenylene diisocyanate, p-phenylene diisocyanate, diphenyl-4,4'-diisocyanate, azobenzene-4,4'-diisocyanate, diphenylsulphone-4,4'-diisocyanate, 2,4-tolylene diisocyanate, dichlorohexa-methylene diisocyanate, furfurylidene diisocyanate, 1-chlorobenzene-2,4-diisocyanate, 4,4',4"-triisocyanatotriphenylmethane, 1,3,5-triisocyanato-benzene, 2,4,6-triisocyanato-toluene, 4,4'-dimethyldiphenyl-methane-2,2',5,5-tetraisocyanate, and the like. While such compounds are commercially available, methods for synthesizing such compounds are well known in the art. Preferred isocyanate-containing compounds include methylenebisphenyldiisocyanate (MDI), isophoronediisocyanate (IPDI) and toluene diisocyanate (TDI), such as toluene-2,4-diisocyanate, toluene-2,6-diisocyanate and mixtures thereof. Other suitable polyisocyanates include polyphenyl polymethylene polyisocyanates; and, polyisocyanates containing additional functional groups other than the isocyanate groups, such as carbodiimide groups, urethane groups, isocyanurate groups, urea groups, or mixtures thereof.

Examples of polyols useful in the invention include polymeric polyols and non-polymeric polyols. Examples of non-polymeric polyols include ethylene glycol; propylene glycol, such as 1,2-propylene glycol and 1,3-propylene glycol; glycerol, pentaerythritol; trimethylolpropane; 1,4,6-octanetriol; butanediol; pentanediol; hexanediol; dodecanediol; octanediol; chloropentanediol; glycerol monoallyl ether; glycerol monoethyl ether; diethylene glycol; 2-ethylhexanediol; 1,4-cyclohexanediol; 1,2,6-hexanetriol; 1,3,5-hexanetriol; 1,3-bis-(2-hydroxyethoxy)propane; and the like. As used herein, the "polymeric polyol" means a polymer that includes multiple hydroxyl groups. Generally, the polymeric polyols useful in the invention include at least 5 repeating units, such as at least 10, 20, 30, 50 or 100 repeating units. Alternatively, the polymeric polyols useful in the invention have an average molecular weight of at least about 500. In some embodiments, the polymeric polyols have an average molecular weight in a range of between about 500 and about 100,000, such as between about 1,000 and about 10,000, between about 10,000 and about 100,000, between about 1,000 and about 7,000 and between about 10,000 and about 70,000. Suitable examples of polymeric polyols include substituted or unsubstituted, aliphatic, aromatic or aliphatic-aromatic, polyether polyols, polyester polyols and polyether-polyester polyols, such as phenoxy resins, substituted or unsubstituted polyalkylene ether glycols and polyhydroxy polyalkylene ethers.

Polyether polyols generally include substituted or unsubstituted, aliphatic, aromatic or aliphatic and aromatic polyethers having a plurality of ether linkages (—O—) and at least two hydroxyl groups. In one embodiment, the polyether polyols are essentially free of pendant or terminal functional groups other than hydroxyl groups. In another embodiment, the polyether polyols optionally contain pendant or terminal functional group(s) other than hydroxyl groups, such as amine groups or mercapto groups.

Examples of polyether polyols include phenoxy resins. Phenoxy resins are well known in the art. Generally, phenoxy resins are polymers that are derived from polymerizing a phenolic diol, HO—X—OH where X is as defined below for Structural Formula (I), and that have a plurality of ether linkages (—O—) and at least two pendant hydroxyl groups. In one embodiment, the phenoxy resins are polymers derived from a reaction of a phenolic diol, such as $CH_2(C_6H_4OH)_2$ or $C(CH_3)_2(C_6H_4OH)_2$, and epichlorohydrin which is optionally substituted by a halogen, an alkyl group of C1-C5, an alkoxy group of C1-C5, phenyl or benzyl. In one embodiment, the phenoxy resins are homopolymers or copolymers that have repeating units of Structural Formula (I):

(I)

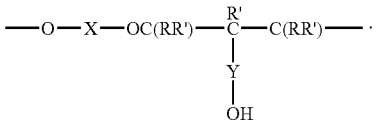

X is represented by Structural Formula (A) or (B) below, where p is 1, 2, 3, 4 or 5:

(A)

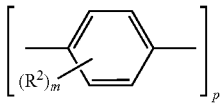

(B)

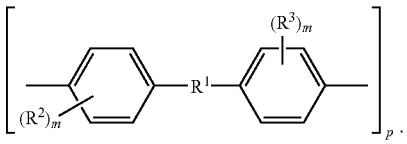

$R^1$ is —C(O)—, —$S(O)_2$—, —O—, —S—, —C(O)N(RR')—, —N(RR')C(O)—, —C(O)O—, —O—C(O)—, an alkylene or alkenylene, or a mixture thereof, or a covalent bond. Each of $R^2$ and $R^3$ is independently an alkyl (e.g., alkyl of C1-C10) or alkoxy (e.g., alkoxy of C1-C10) group, or a halogen (e.g., —F, —Cl, —Br— or —I). In Structural Formulas (A) and (B), m is 0, 1, 2, 3 or 4. Preferably, p is 1 or 2, more preferably 1, for each of Structural Formulas (A) and (B). The linker Y is —C(O)—; —$S(O)_2$—; —O—; —S—; —C(O)N(RR')—; —N(RR')C(O)—; —C(O)O—; —O—C(O)—; a substituted or unsubstituted hydrocarbylene, such as liner, branched or cyclic alkylene (e.g., —CRR'—) or alkenylene (e.g., —CRR'═CRR'—), or arylene (e.g., —($C_6H_4$)—); or a mixture thereof; or a covalent bond. R and R' are each independently —H, substituted or unsubstituted lower alkyl (e.g. C1-C10), phenyl, benzyl or a halogen, preferably —H.

Preferably, X is represented by Structural Formula (B). In a more preferred embodiment, X is represented by Structural Formula (B) and $R^1$ is an alkylene group, such as —$(CRR')_q$— where q is 1, 2, 3, 4 or 2. In another more preferred embodiment, X is represented by Structural Formula (B); $R^1$ is an alkylene group, such as —$(CRR')_q$— where q is 1, 2, 3, 4 or 5, preferably 1 or 2; and p is 1.

In a specifically preferred embodiment, the phenoxy resins are homopolymers or copolymers, preferably homopolymers, which include a polymeric unit represented by Structural Formula (II):

(II)

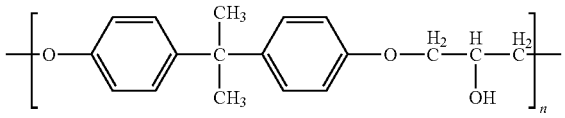

where n is an integer greater than zero, such as greater than about 5, greater than about 10, greater than about 30, greater than about 50, or greater than about 100. In some embodiments, the phenoxy resins of Structural Formula (II) have an average molecular weight of at least about 1,000, such as in a range of between about 10,000 and about 100,000, preferably in a range of between about 10,000 and about 70,000. Certain phenoxy resins characterized by Structural Formula (II) are commercially available, for example, as PKHH® (InChemRez), PKHA® (InChemRez), PKHB® (InChemRez), PKHJ® (InChemRez), PKFE® (InChemRez) and PKHC® (InChemRez) phenoxy resins.

In another specifically preferred embodiment, the phenoxy resins are caprolactone-modified phenoxy resins represented by Structural Formula (III):

(III)

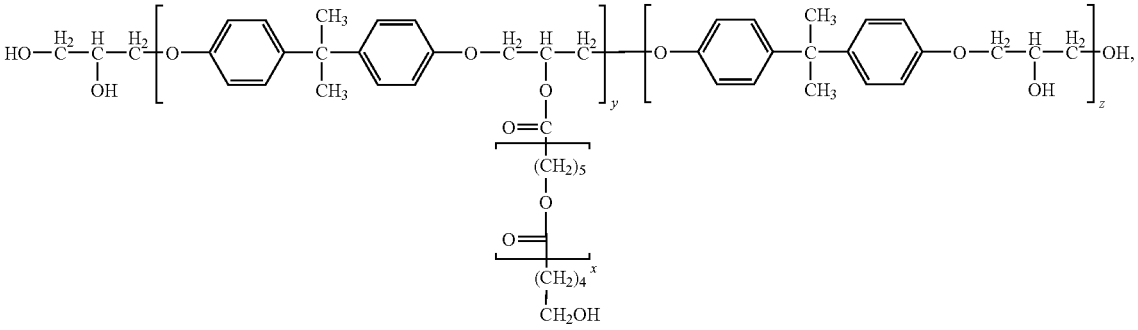

where each of x, y and z is independently an integer greater than zero. In some embodiments, the phenoxy resins of Structural Formula (III) have an average molecular weight of at least about 1,000, such as in a range of between about 10,000 and about 100,000, preferably in a range of between about 10,000 and about 70,000.

Other examples of polyether polyols that can be employed in the invention include polyoxyalkylene polyols, such as polyethylene glycol, polypropylene glycol, polybutylene glycol and the like. Further, homopolymers and copolymers of the polyoxyalkylene polyols can also be employed in the invention. Specific examples of copolymers of the polyoxyalkylene polyols include copolymers of at least one compound selected from the group consisting of ethylene glycol, propylene glycol, diethylene glycol, dipropylene glycol, triethylene glycol, 2-ethylhexanediol-1,3glycerin, 1,2,6-hexane triol, trimethylol propane, trimethylol ethane, tris(hydroxyphenyl)propane, triethanolamine, triisopropanolamine, ethylenediamine and ethanolamine; with at least one compound selected from the group consisting of ethylene oxide, propylene oxide and butylene oxide.

Polyester polyols generally include substituted or unsubstituted, aliphatic, aromatic, or aliphatic-aromatic polyesters having a plurality of ester linkages (—C(O)O—) and at least two hydroxyl groups. In one embodiment, the polyester polyols are essentially free of pendant or terminal functional groups other than hydroxyl groups. In another embodiment, the polyester polyols optionally contain additional pendant or terminal functional group(s) other than hydroxyl groups, such as amine group(s) or mercapto group(s). Examples of polyester polyols suitable for the invention include poly(1,4-hexamethylene adipate), poly(1.6-hexamethylene adipate) and ortho-phthalate-diethylene glycol based polyester polyols.

Polyester-polyether polyols generally include substituted or unsubstituted, aliphatic, aromatic or aliphatic-aromatic polymeric polyols having a plurality of ester linkages and a plurality of ether linkages. In one embodiment, the polyester-polyether polyols are essentially free of pendant or terminal functional groups other than hydroxyl groups. In another embodiment, the polyester-polyether polyols optionally contain additional pendant or terminal functional group(s) other than hydroxyl groups, such as amine group(s) or mercapto group(s). For example, polyester-polyether polyols include one or more linkages as shown in Structural Formula (IV):

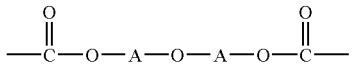

(IV)

where each A can be the same or different, and can independently be substituted or unsubstituted, aliphatic, aromatic or aliphatic-aromatic, such as $—(CH_2)_a$, $—(CH_2)_b—(C_6H_4)_a—$ or $(C_6H_4)_b$ where a and b are each independently an integer, such as 1, 2, 3, 4, or 5.

Commercially available polyols which can be used in the practice of the invention include ARCOL™ PPG 2025 (Bayer), PolyG™ 20-56 (Arch), PLURACOL™ P-2010 (BASF), DYNACOLL™ 7360 (Creanova), FORMEZ™ 66-32 (Crompton), RUCOFLEX™ S-105-30 (Bayer), PolyBD® R-45HTLO (Elf Atochem), THANOL™ R-510 and PKHS®-40 (InChemRez) polypols.

Examples of other curing agents useful in the invention for preparing the non-blocked urethane prepolymers include diamino polypropylene glycol; diamino polyethylene glycol; and polythioethers, such as the condensation products of thiodiglycol either alone or in combination with other glycols (e.g., ethylene glycol or 1,2-propylene glycol) or with other non-polymeric polyhydroxy compounds described above. Also, small amounts of low molecular weight dihydroxy, diamino, or amino hydroxy compounds can be used such as saturated and unsaturated glycols e.g. ethylene glycol or condensates thereof, such as diethylene glycol, triethylene glycol, and the like; ethylene diamine, hexamethylene diamine and the like; ethanolamine, propanolamine, N-methyldiethanolamine and the like.

Optionally, for the preparation of the non-blocked urethane prepolymers useful in the invention, a catalyst can further be used for effecting a polymerization to form a urethane linkage (—NH—C(O)O—). Generally, any urethane catalyst capable of effecting a polymerization to form the urethane linkage may be used in the present invention. Examples of suitable urethane catalysts include tetramethylbutanediamine (TMBDA), 1,4-diaza(2,2,2)bicyclooctane (DABCO), dibutyltindilaurate (DBTDL) and tinoctoate (SnOct), and mixtures thereof.

In a preferred embodiment, the non-blocked urethane prepolymers employed in the invention are non-blocked polymeric urethane prepolymers. The free isocyanate groups of the non-blocked, polymeric urethane prepolymers can be positioned as terminal groups or pendant groups attached to the polymer backbone, or as both. In some embodiments, the non-blocked urethane prepolymers are free of functional groups other than the isocyanate groups, such as free of acrylate groups. In other embodiments, the non-blocked urethane prepolymers include addition functional groups, such as carbodiimide groups, urethane groups, isocyanurate groups, urea groups, or mixtures thereof. In a preferred embodiment, the non-blocked urethane prepolymers that can be used in the invention include diisocyanate-terminated polymers. Specifically preferred non-blocked urethane prepolymers that can be used in the invention include diisocyanate-terminated polyesters, diisocyanate-terminated polyethers, diisocyanate-terminated polyether-polyesters, and combinations thereof. Features of the polyesters, polyethers and polyether-polyesters of the urethane prepolymers are as described above for the polyester-, polyether-, and polyester-polyether based polyols. Examples of the diisocynate-terminated polyesters include polyester-based methylenebisphenyldiisocyanate (MDI), polyester-based isophoronediisocyanate (IPDI), polyester-based toluene diisocyanate (TDI) (e.g., toluene-2,4,2,6-diisocyanate) and mixtures thereof. Examples of the diisocynate-terminated polyethers include polyether-based MDI, polyether-based IPDI, polyether-based TDI and mixtures thereof. Examples of the diisocynate-terminated polyether-polyesters include polyether-polyester-based MDI, polyether-polyester-based IPDI, polyether-polyester-based TDI and mixtures thereof.

In one specific embodiment, a polyether-based MDI prepolymer that can be used in the invention is represented by Structural Formula (V):

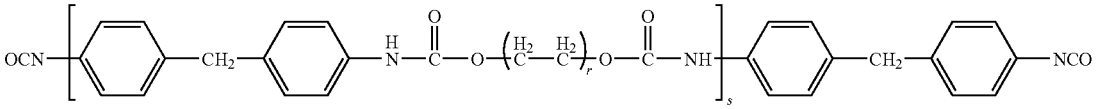

(V)

where each of r and s is independently an integer greater than zero.

Suitable polyether-based MDI prepolymers include VERSATHANE™ SME-75A (Air Products Corporation), VERSATHANE™ SME-80A (Air Products Corporation), VERSATHANE™ SME-90A (Air Products Corporation), VERSATHANE™ SME-95A (Air Products Corporation), RUBINATE® 9009 (ICI) and RUBINATE® 1027 (ICI), VIBRATHANE™ B-625 (Uniroyal), VIBRATHANE™

B-635 (Uniroyal), VIBRATHANE™ B-670 (Uniroyal) and VIBRATHANE™ B-836 (Uniroyal), and ANDUR™ M-10 (Anderson Development Company) prepolymers. Other examples include homopolymers or copolymers of polyoxypropylene glycol based TDI prepolymers.

The polyurethane adhesive compositions employed in the invention are made by combining a non-blocked urethane prepolymer as described above and a polymeric polyol. Features and examples of polymeric polyols, including preferred examples, are as described above for the general curing agents. Preferred polymeric polyols include substituted or unsubstituted, aliphatic, aromatic or aliphatic-aromatic, polyether polyols, polyester polyols, and polyether-polyester polyols, as described above. More preferred polymeric polyols include phenoxy resins, even more preferably phenoxy resins of Structural Formulas (II) and (III), as described above. The particular prepolymer selected is generally matched with the particular curing agent(s) desired in order to achieve a polyurethane adhesive resin material having the desired physical characteristics and chemical resistance characteristics for the particular application.

The polyurethane adhesive compositions employed in the invention preferably include a non-blocked urethane prepolymer and a polymeric polyol, as described above, in a ratio of between about 20:1 and about 3:1, such as between about 20:1 and about 5:1, between about 10:1 and about 3:1, or between about 10:1 and about 5:1. Optionally the polyurethane adhesive compositions can further include one or more catalysts for effecting a polymerization to form the urethane linkage. Examples of such catalysts are as described above.

In a preferred embodiment, the polyurethane adhesive compositions employed in the invention have a pot life in a range of between about 0.5 hours and about 4 hours, such as between about 1 hour and about 4 hours, between about 1 hour and about 2 hours, between about 1.5 hours and about 4 hours or between about 2 hours and about 4 hours. As used herein, the "pot life" of a polyurethane adhesive composition means the time period during which the composition, once it has been formed, can be applied to a substrate with an application weight, wherein the weight ratio between the substrate and the application weight is in a range of between about 1:3 and about 1:15, substrate to application weight. Preferably, the weight ratio between the substrate and the application weight is in a range of between about 1:5 and about 1:10, substrate to application weight. The substrate weight is the weight per unit area of the substrate, which, for example, can be measured by taking the weight of the substrate of known surface area in unit, such as grams per square meter (GSM). The application weight is the net weight of the polyurethane adhesive formulation applied to a unit area of the substrate by roll coating, impregnation, spray, or other means and is measured in unit, such as GSM.

In another preferred embodiment, the viscosity of a polyurethane adhesive composition employed in the invention increases by less than about 100%, preferably less than about 75%, more preferably less than about 50%, of the initial viscosity of the polyurethane adhesive composition for a period of time in a range of about 1 hour and about 4 hours, such as between about 1 hour and about 2 hours, between about 1.5 hours and about 4 hours, between about 2 hours and about 4 hours or between about 1 hour and about 1.5 hours. As used herein, the "initial viscosity" of the polyurethane adhesive composition means a viscosity of the polyurethane adhesive composition measured about 1 minute after combining a non-blocked urethane prepolymer and a polymeric polyol, and other optional ingredients as described above, at about 37.8° C. Even more preferably, the viscosity of a polyurethane adhesive composition employed in the invention increases by less than about 35% of the initial viscosity of the polyurethane adhesive composition for a period of time in a range of about 1 hour and about 4 hours, such as between about 1 hour and about 2 hours, between about 1.5 hours and about 4 hours, between about 2 hours and about 4 hours or between about 1 hour and about 1.5 hours.

In another preferred embodiment, the polyurethane adhesive compositions employed in the invention have an initial viscosity in a range of between about 1,500 cps (centipoises) and about 5,000 cps, such as between about 2,000 cps and about 4,000 cps, or between about 2,500 cps and about 3,500 cps.

The polyurethane adhesive compositions described above can be used for forming one or more adhesive layers of coated abrasive tools. Application of a polyurethane adhesive composition as described above over a substrate forms a polyurethane-adhesive-composition-coated substrate. The polyurethane-adhesive-composition-coating over the substrate is generally cured to thereby form a polyurethane adhesive resin coating over the substrate. In one embodiment, the polyurethane adhesive compositions are cured by exposure to heat to form the corresponding polyurethane adhesive resin coatings. In another embodiment, the polyurethane adhesive compositions are cured by exposure to a radiation energy, such as an ultraviolet, visible, infrared, or microwave radiation energy, preferably a microwave radiation energy. In one specific embodiment, the polyurethane adhesive compositions are cured by exposure to heat at a temperature in a range of between about 100° C. and about 250° C., preferably between about 100° C. and about 150° C. The formed polyurethane adhesive coating can be any adhesive layer of coated abrasive tools.

Figure 2:
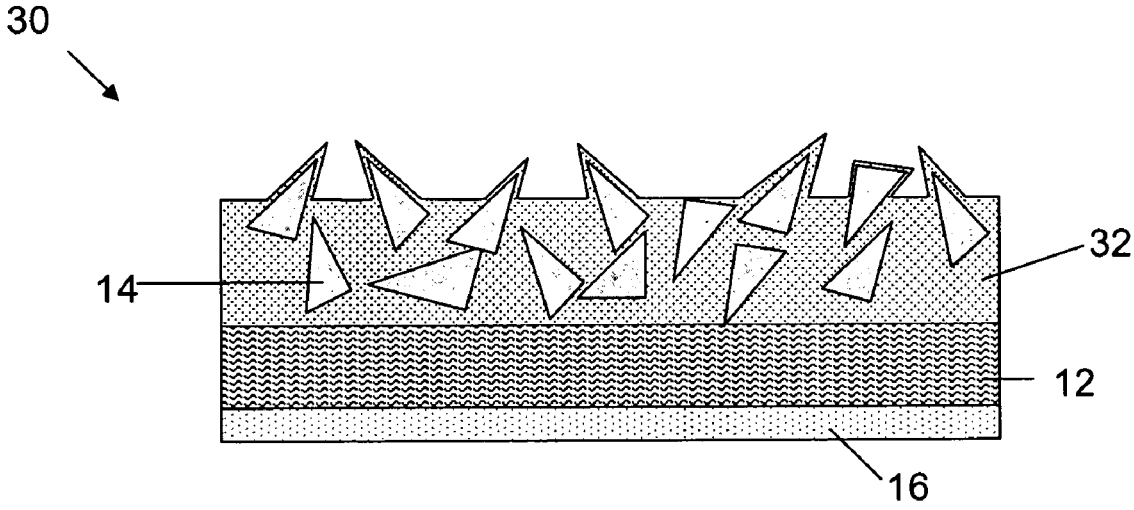
FIG. 2 is a schematic representation of a cross-sectional view of another embodiment of coated abrasive tools of the invention.

Coated abrasive tools of the invention generally include a substrate, an abrasive material and at least one binder to hold the abrasive material to the substrate. As used herein, the term "coated abrasive tool" encompasses a nonwoven abrasive tool. The abrasive material, such as abrasive grains, particles or agglomerate thereof, can be present in one layer (e.g., resin-abrasive layer) or in two layers (e.g., make coat and size coat) of the coated abrasive tools. Examples of such coated abrasive tools that can be made by the methods of the invention are shown in FIGS. 1 and 2. Referring to FIG. 1, in coated abrasive tools 10, substrate 12 is treated with optional backsize coat 16 and optional presize coat 18. Overlaying the optional presize coat 18 is make coat 20 to which abrasive material 14, such as abrasive grains or particles, are applied. Size coat 22 is optionally applied over make coat 20 and abrasive material 14. Overlaying size coat 22 is optional supersize coat 24. Depending upon their specific applications, coated abrasive tools 10 may or may not include backsize coat 16 and/or presize coat 18. Also, depending upon their specific applications, coated abrasive tools 10 may or may not include size coat 22 and/or supersize coat 24. Shown in FIG. 2 is an example of coated abrasive tools that can be formed by the methods of the invention, where coated abrasive tools 30 includes a single layer of an abrasive material and adhesive(s) (binder-abrasive layer 32) and optionally backsize coat 16. Optionally, presize coat 18, size coat 22 and supersize coat 24, as shown in FIG. 1, can be included in coated abrasive tools 30.

In some embodiments, the polyurethane adhesive compositions described above are used in forming at least one layer selected from the group consisting of binder-abrasive layer 32, backsize coat 16, presize coat 18, make coat 20, size coat 22 and supersize coat 24. In a specific embodiment, the polyurethane adhesive compositions described above are used in forming at least one adhesive layer selected from the group consisting of presize coat 18, make coat 20 and size coat 22. In a preferred embodiment, the polyurethane adhesive compositions described above are used to form a binder for affixing abrasive materials 14 to substrate 12, for example, for forming binder-abrasive layer 32 or at least one coat of coats 20 (make coat) and 22 (size coat). In a specifically preferred embodiment, the polyurethane adhesive compositions described above are used to form a binder for binder-abrasive layer 32. In these embodiments, abrasive material 14 can be applied separately by gravity, electrostatic deposition or in air stream, or as slurry together with the polyurethane adhesive compositions.

Substrate 12 may be impregnated either with a resin-abrasive slurry or a resin binder without abrasive grains, depending upon the required aggressiveness of the finished coated abrasive tools, as described above. Substrate 12 useful in the invention can be rigid, but generally is flexible. Substrate 12 can be paper, cloth, film, fiber, polymeric materials, nonwoven materials, vulcanized rubber or fiber, etc., or a combination of one or more of these materials, or treated versions thereof. The choice of the substrate material generally depends on the intended application of the coated abrasive tool to be formed. In a preferred embodiment, substrate 12 is a nonwoven material. As used herein, "nonwoven" means a web of random or directional fibers held together mechanically, chemically, or physically, or any combination of these. Examples of nonwoven materials include fibers formed into a nonwoven web that provides as a three-dimensional integrated network structure. Any fibers known to be useful in nonwoven abrasive tools can be employed in the invention. Such fibers are generally formed from various polymers, including polyamides, polyesters, polypropylene, polyethylene and various copolymers thereof. Cotton, wool, blast fibers and various animal hairs can also be used for forming nonwoven fibers. In some applications, the nonwoven substrate can include a collection of loose fibers, to which abrasive materials 14 are added to provide an abrasive web having abrasive materials 14 throughout.

Depending upon for which adhesive layer(s) a polyurethane adhesive composition as described above is utilized, abrasive material 14 is applied over a substrate prior to, after and/or simultaneously with the application of the polyurethane adhesive composition to the substrate. Abrasive material 14 can be applied over substrate 12 by spraying (via gravity, electrostatic deposition or air stream) or coating with a binder that preferably includes a polyurethane adhesive made from a polyurethane adhesive composition as described above. In a specific embodiment, abrasive material 14 is applied over substrate 12 simultaneously with the polyurethane adhesive composition. In one example of this embodiment, as shown in FIG. 2, the polyurethane adhesive composition and abrasive material are mixed together to form a binder-abrasive composition slurry, and the slurry is applied over substrate 12 to form single binder-abrasive composition layer 32. In another specific embodiment, abrasive material 14 is applied over a polyurethane-adhesive-coated substrate. In one example of this embodiment, the polyurethane adhesive composition is used for forming at least one of the backsize, presize and make coats. In yet another embodiment, abrasive material 14 is applied prior to the application of the polyurethane adhesive composition to substrate 12. In one example of this embodiment, the polyurethane adhesive composition is used for forming at least one of the size and supersize coats.

Adhesive materials 14 useful in the invention can be of any conventional ones utilized in the formation of coated abrasive tools. Suitable abrasive material for use in the invention include diamond, corundum, emery, garnet, chert, quartz, sandstone, chalcedony, flint, quartzite, silica, feldspar, pumice and talc, boron carbide, cubic boron nitride, fused alumina, ceramic aluminum oxide, heat treated aluminum oxide, alumina zirconia, glass, silicon carbide, iron oxides, tantalum carbide, cerium oxide, tin oxide, titanium carbide, synthetic diamond, manganese dioxide, zirconium oxide, and silicon nitride. The abrasive materials can be oriented or can be applied to the substrate without orientation (i.e., randomly), depending upon the particular desired properties of the coated abrasive tools. In choosing an appropriate abrasive material, characteristics, such as size, hardness, compatibility with workpieces and heat conductivity, are generally considered. Abrasive materials useful in the invention typically have a particle size ranging from about 0.1 micrometer and about 1,500 micrometers, such as from about 10 micrometers to about 1000 micrometers.

In a specific embodiment, abrasive materials 14 useful in the invention are at least partially coated with an organosilicon compound. In another specific embodiment, abrasive materials 14 useful in the invention are at least partially coated with a fused layer of glass, ceramic or combination thereof, and the fused layer is at least partially coated with an organosilicon compound.

Preferably, the fused layer includes fired glass frit or fused silica. The fused layer can have a thickness less than about 2 μm, preferably less than about 1 μm. The term "fused" is used herein to generally describe the material generated by firing a glass precursor to form a glassy or vitrified material. The term "fused" is also used herein to generally describe a material formed by sintering or otherwise densifying a ceramic precursor, for example, a powder, paste or a green ceramic material. Examples of suitable compositions of the fused layer are described, for example, in U.S. Pat. Nos. 5,401,284 and 5,536,283, the entire teachings of which are incorporated herein by reference. The fused layer can entirely cover the surface of the abrasive material 14. Alternatively, only a portion, such as at least about 50% or at least about 70% of the surface of abrasive material 14, is coated with the fused layer.

Examples of suitable organosilicon compounds include silanes, such as organosilanes having amino, alkoxy, alkylalkoxy, alkyltrialkoxy, vinyl, acrylo, methacrylo, mercapto and other functional groups. Specific examples include aminosilanes such as aminoalkyltrialkoxysilanes, aminoethyltriethoxysilane, aminopropyltriethoxysilane and phenylaminoalkyltrialkoxysilane. Siloxanes, silicon fluids, silsesquioxanes and others also can be employed, as can be combinations of organosilicon compounds. Abrasive materials 14 coated with a fused layer as described above can be wetted, as known in the art, with a solution that includes an organosilicon compound as described above and a solvent, such as, for example, water. Concentrations as low as 2 volume percent can be employed. In the case of aminoalkyltrialkoxysilanes, for example, suitable concentrations employed in the silanization process range from about 2 to about 6 weight percent. The quantity of silane solutions employed depends on the weight of the grain to be coated and the grit size. The wet grains can be dried, for example in an oven. Spraying in-situ and other methods known in the art also can be employed for treating the coated abrasive materials 14 with an organosilicon compound as described above.

Suitable binders for preparing the adhesive layer(s) of coated abrasive tools 10 and 30 other than the polyurethane adhesive resins made from the combination of non-blocked polyurethane prepolymers and polymeric polyols, as described above, include cured versions of hide glue and varnish, and resins, such as phenolic, ureaformaldehyde, melamine-formaldehyde, epoxy and acrylic resins. One or more of these binders can be used independently or in combination with the polyurethane adhesives made from the combination of non-blocked polyurethane prepolymers and polymeric polyols, as described above. When one or more of the conventional binders are used in combination with the polyurethane adhesives made from the combination of non-blocked polyurethane prepolymers and polymeric polyols, as described above, the conventional binder(s) can be in an amount of up to about 35% by weight based on the weight of the total binder coating composition.

The adhesive layer(s) of coated abrasive tools 10 and 30 can be made by any suitable methods generally known in the art. In one embodiment, optional backsize coat 16 and optional presize coat 18, of a binder composition without containing abrasive materials 14, are coated on substrate 12 and cured by exposure to heat in order to impart sufficient strength to substrate 12 for further processing. Then, make coat 20 of a binder composition that includes one or more of the above-mentioned binders is applied to substrate 12 to secure abrasive materials 14 throughout substrate 12, and while the binder composition is still tacky, abrasive materials 14 are applied over make coat 20. The binder composition is subsequently cured so as to hold abrasive materials 14 in place. Thereafter, size coat 22 of a binder composition that includes one or more of the above-mentioned binders is applied over substrate 12, and then cured. The primary function of size coat 22 generally is to anchor abrasive materials 14 in place and allow them to abrade a workpiece without being pulled from the coated abrasive structure before their grinding capability has been exhausted.

In some cases, supersize coat 24 is deposited over size coat 22. Supersize coat 24 can be deposited with or without a binder, as described above. Generally, the function of supersize coat 24 is to place on a surface of coated abrasive materials 14 an additive that provides special characteristics, such as enhanced grinding capability, surface lubrication, anti-static properties or anti-loading properties. Examples of suitable grinding aids include $KBF_4$ and calcium carbonate. Examples of suitable lubricants for supersize coat 24 include lithium stearate and sodium laurel sulfate. Examples of suitable anti-static agent include alkali metal sulfonates, tertiary amines and the like. Examples of suitable anti-loading agents include metal salts of fatty acids, for example, zinc stearate, calcium stearate and lithium stearate and the like. Anionic organic surfactants can also be used effective anti-loading agents. A variety of examples of such anionic surfactants and antiloading compositions including such an anionic surfactant are described in U.S. Patent Application Publication No. 2005/0085167 A1, the entire teachings of which are incorporated herein by reference. Other examples of suitable anti-loading agents include inorganic anti-loading agents, such as metal silicates, silicas, metal carbonates and metal sulfates. Examples of such inorganic anti-loading agents can be found in WO 02/062531, the entire teachings of which are incorporated herein by reference.

In another embodiment, a slurry of abrasive materials 14 and a binder composition that includes one or more of the above-mentioned binders is applied over substrate 12, optionally on presize coat 18 over substrate 12, and then cured. Generally, each of the above-mentioned binder compositions for various coats of abrasive tools 10 and 30 includes one or more precursors of the above-mentioned binders, including a polyurethane adhesive composition as described above.

In a preferred embodiment, coated abrasive tools made by the use of the polyurethane adhesive compositions described above include a nonwoven substrate, such as a nonwoven substrate made from an air-laid process which is well known in the art. The nonwoven substrate is impregnated with a coating slurry composition that includes a non-blocked urethane prepolymer and a polymeric polyol, as described above, and an abrasive material, such as fine abrasive particles. The uncured, impregnated nonwoven substrate is wound spirally to form a log. Alternatively, the uncured impregnated nonwoven substrate is cut into sheets and the sheets are stacked between two metal plates to form a slab. The log or slab is then heated to form the nonwoven abrasive tool. Optionally, the cured log or slab is converted into a final shape normally used for polishing, deburring, or finishing applications in the metal or wood industries.

The polyurethane adhesive compositions employed in the invention can optionally further include one or more additives, such as fillers, coupling agents, fibers, lubricants, surfactants, pigments, dyes, wetting agents, grinding aids, anti-loading agents, anti-static agents and suspending agents. Specific additive(s) that is included in the polyurethane adhesive compositions employed in the invention can be chosen depending upon for which adhesive layer(s) (e.g., coats 16, 18, 20, 22, 24 and 32 of FIGS. 1 and 2) the polyurethane adhesive compositions are employed. For example, supersize coat 24 can include one or more anti-loading agents. One or more grinding aids can be included in size coat 22 and/or make coat 20. The amounts of these materials are selected, depending upon desired properties to achieve.

The present invention also includes coated abrasive tools that are made by the methods described above, such as coated abrasive tools 10 and 30 shown in FIGS. 1 and 2. The coated abrasive tools of the invention include a substrate; a polyurethane adhesive resin coating over the substrate, the resin being formed from a polymerization reaction of a non-blocked urethane prepolymer with a phenoxy resin; and an abrasive material over the substrate. Features and examples of the coated abrasive tools of the invention are as described above for coated abrasive tools made by the methods of the invention, including features and examples of the substrate, non-blocked urethane prepolymer and phenoxy resin.

Coated abrasive tools that are formed by the methods of the invention and coated abrasive tools of the invention generally take the form of sheets, discs, belts, bands, and the like, which can be further adapted to be mounted on pulleys, wheels, or drums. The coated abrasive tools can be used for sanding, grinding or polishing various surfaces of, for example, steel and other metals, wood, wood-like laminates, plastics, fiberglass, leather or ceramics.

EXEMPLIFICATION

Example 1

Preparation of Nonwoven Abrasive Tools

Nonwoven abrasive tools, formed of MPT 904 nonwoven substrate, were prepared as follows. The nonwoven substrate MPT-904 was made of Nylon 6,6 staples on an air-laid process and had a final weight between 140 and 180 grams per square meter (GSM). The Nylon 6,6 staples were about 3.8 centimeter (cm) in length and had 2-4 crimps per cm. After the web formation, both sides of the web were sprayed with an acrylic latex formulation based on Hycar 26138, commercially available from Noveon. The dry weight of the latex spray was between 38 to 54 GSM with the balance weight came from the Nylon staples. A binder-abrasive composition slurry as shown in Tables 1-3 was applied to the nonwoven substrate MPT 904 with the wet application weight of 930-1,140 GSM. Comparative nonwoven abrasive tools were also prepared similarly with binder-abrasive compositions as indicated in Tables 1-3 (Table 1 for nonwoven abrasive tools having silicone carbide of ANSI 180 grading as an abrasive material (S/C 180); Table 2 for nonwoven abrasive tools having silicone carbide of ANSI 120 grading (S/C 120); and Table 3 for nonwoven abrasive tools having alumina oxide of ANSI 120 grading (A/O 120)).

The uncured coated substrate was wound continuously and spirally under pressure to form a log. The log was then placed in an oven at temperatures between about 100° C. and about 150° C. for about 24 hours to complete the cure cycle. The cured log was then converted into the right dimensions for testing by truing and slicing. In the separate preparation procedure, the uncured coated substrate was pre-cut into sheets of about 25×25 cms. The sheets were stacked on top of each other and the stack was placed in between two metal plates. The plates were then compressed to desired thickness, such as 2.54 cms. The fixed thickness stack assembly was then placed in an oven at about 100° C. and about 150° C. for about 16 hours to complete the cure cycle. The cured slab was then removed from the metal plates and cut into the discs for testing.

TABLE 1

Binder-Abrasive Compositions for Nonwoven Abrasive Tools Having 180 S/C Abrasive Materials

| Description | Control A (wt %) | Control B (wt %) | Composition of the Invention I1 |
|---|---|---|---|
| MIBK | 13.12 | 12.38 | 16.50 |
| Dura | 7.20 | | |
| Zonyl FSJ-100 | 0.11 | 0.125 | |
| Teflon 7C | 0.43 | | |
| Talc | | 3.00 | 2.00 |
| Calcium Stearate | 1.29 | 4.00 | 4.50 |
| Vibrathane 8020 (urethane prepolymer) | 27.38 | 30.00 | 21.00 |
| Airthane PCG 475A | 5.18 | | |
| 180 S/C E291 | 21.61 | | |
| 180 S/C MA | 10.81 | | |
| 150 S/C MA | 10.81 | | |
| 180 S/C Silane | | 48.00 | 51.00 |
| TMP (trimethylolpropane) | 0.49 | 1.50 | |
| Pigment | 1.47 | 1.00 | 1.00 |
| Phenoxy PKHS-40 | | | 4.00 |

Figure 3:
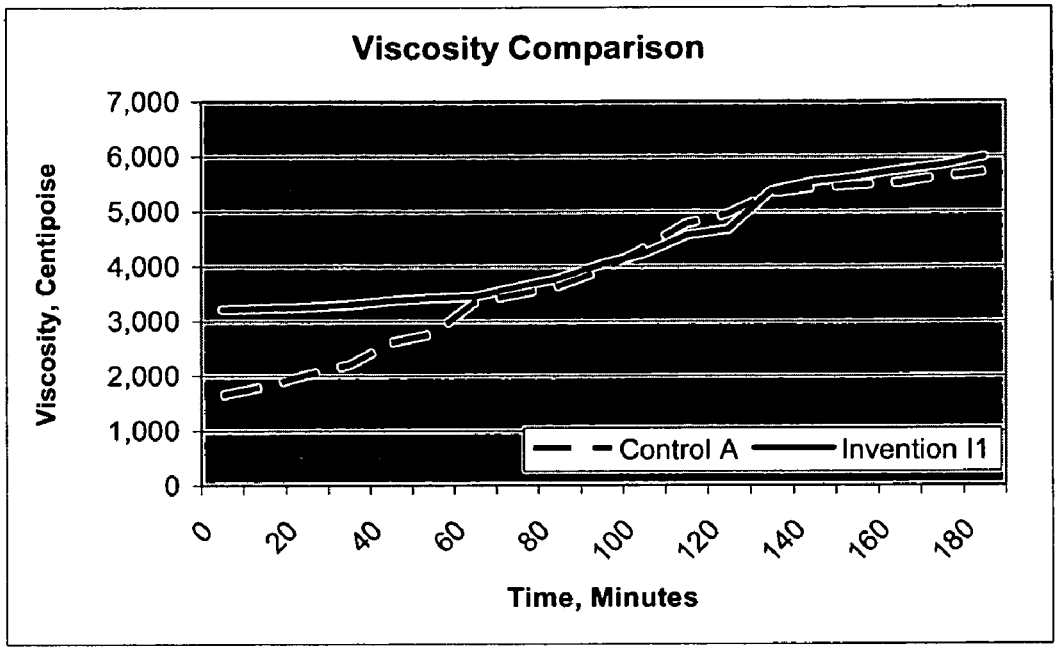
FIG. 3 is a graph comparing the viscosity change of a polyurethane adhesive composition employed in the invention over time with that of a control composition.

FIG. 3 compares the viscosity change of the formula of I1 over time with that of Control A. The viscosity was measured with a Brookfield viscometer of model DV-I while keeping the formulas at 37.8° C. As shown in FIG. 3, the viscosity of I1 formula stayed relatively constant for about 80 minutes. In contrast, the viscosity of control A formula increased rapidly right from the start. For example, to reach about 50% increase based upon the initial viscosity, it took about 110 minutes in the I1 formula, while it took about 45 minutes in the control A formula. A stable viscosity for a period of time is generally desirable for application weight control consistency.

TABLE 2

Binder-Abrasive Compositions for Nonwoven Abrasive Tools Having 120 S/C Abrasive Materials

| Description | Control C (wt %) | Composition of the Invention I2 |
|---|---|---|
| MIBK | 12.92 | 16.00 |
| Dura | 7.20 | |
| Zonyl FSJ-100 | 0.11 | |
| Teflon 7C | 0.43 | |
| Talc | | 2.00 |
| Calcium Stearate | 1.29 | 4.50 |
| Vibrathane 8020 (urethane prepolymer) | 27.38 | 21.00 |
| Airthane PCG 475A | 5.18 | |
| 120 S/C E291 | 32.62 | |
| 120 S/C MA | 10.61 | |
| 120 S/C Silane Treated | | 51.00 |
| TMP (trimethyloipropane) | 0.49 | |
| Pigment | 1.47 | 0.50 |
| Phenoxy PKHS-40 | | 4.00 |

TABLE 3

Binder-Abrasive Compositions for Nonwoven Abrasive Tools Having 120 A/O Abrasive Materials

| Description | Control D (wt %) | Control E (wt %) | Composition of the Invention I3 | Composition of this Invention I4 |
|---|---|---|---|---|
| MIBK | 11.22 | 11.22 | 17.00 | 16.00 |
| Dura | 8.81 | 8.81 | | |
| Zonyl FSJ-100 | 0.11 | 0.11 | | |
| Teflon 7C | 0.53 | 0.53 | | |
| Talc | | | 2.50 | 2.50 |
| Cab-O-Sil M5 | 0.30 | 0.30 | | |
| Calcium Stearate | 1.59 | 1.59 | 4.00 | 4.00 |
| Vibrathane 8020 (urethane prepolymer) | 33.50 | 33.50 | 21.00 | 21.00 |
| Airthane PCG 475A | 6.32 | 6.32 | | |
| 120 A/O | 37.00 | | | |
| 120 A/O Silane Treated | | 37.00 | 46.00 | 41.00 |
| TMP (trimethylolpropane) | 0.62 | 0.62 | | |
| Phenoxy PKHS-40 | | | 4.00 | 4.00 |

TABLE 4

Characteristics of the Nonwoven Abrasive Wheels of Example 1

| Type | Density Code | Grams per $cm^3$ | Diameter (cm) | Yds[a] | Reams[b] | Fiber Wt%[c] | Abrasive Wt%[c] | Phenoxy Resin Wt%[c] | PU (polyurethane) Resin Wt%[c] | Lubricant Wt%[c] | Filler Wt%[c] | Binder Wt%[c] |
|---|---|---|---|---|---|---|---|---|---|---|---|---|
| Control A | 6 | 0.44-0.55 | 15 | 9.1 | 0.33 | 8.76 | 40.08 | 0.00 | 29.69 | 1.59 | 6.67 | 3.13 |
| Control A | 7 | 0.55-0.66 | 15 | 11.1 | 0.40 | 8.76 | 40.08 | 0.00 | 29.69 | 1.59 | 6.67 | 3.13 |
| Control A | 8 | 0.66-0.77 | 20 | 19.9 | 0.72 | 8.76 | 40.08 | 0.00 | 29.69 | 1.59 | 6.67 | 3.13 |
| Control A | 9 | 0.78-0.89 | 20 | 24.3 | 0.88 | 8.76 | 40.08 | 0.00 | 29.69 | 1.59 | 6.67 | 3.13 |
| Control B | 9 | 0.78-0.89 | 20 | 29.4 | 1.07 | 11.91 | 46.28 | 0.00 | 30.37 | 3.86 | 2.89 | 4.41 |

TABLE 4-continued

Characteristics of the Nonwoven Abrasive Wheels of Example 1

| Type | Density Code | Grams per $cm^3$ | Diameter (cm) | Yds[a] | Reams[b] | Fiber Wt%[c] | Abrasive Wt%[c] | Phenoxy Resin Wt%[c] | PU (polyurethane) Resin Wt%[c] | Lubricant Wt%[c] | Filler Wt%[c] | Binder Wt%[c] |
|---|---|---|---|---|---|---|---|---|---|---|---|---|
| Control C | 9 | 0.78-0.89 | 20 | 24.3 | 0.88 | 8.76 | 40.08 | 0.00 | 29.69 | 1.59 | 6.67 | 3.13 |
| Control D | 9 | 0.78-0.89 | 20 | 28.5 | 1.04 | 9.93 | 38.32 | 0.00 | 36.42 | 2.20 | 9.46 | 3.67 |
| Control E | 9 | 0.78-0.89 | 20 | 28.5 | 1.04 | 9.93 | 38.32 | 0.00 | 36.42 | 2.20 | 9.46 | 3.67 |
| I3 of the invention | 9 | 0.78-0.89 | 20 | 28.5 | 1.04 | 11.93 | 47.02 | 4.09 | 21.46 | 4.09 | 2.56 | 4.41 |
| I4 of the invention | 9 | 0.78-0.89 | 20 | 28.5 | 1.04 | 12.61 | 46.78 | 4.57 | 23.96 | 4.57 | 2.84 | 4.67 |
| I2 of the invention | 9 | 0.78-0.89 | 20 | 28.1 | 1.02 | 12.39 | 51.16 | 4.01 | 21.06 | 4.51 | 2.01 | 4.58 |
| I1 of the invention | 6 | 0.44-0.55 | 15 | 12.4 | 0.45 | 12.39 | 51.16 | 4.01 | 21.06 | 4.51 | 2.01 | 4.58 |
| I1 of the invention | 7 | 0.55-0.66 | 15 | 14.9 | 0.54 | 12.39 | 51.16 | 4.01 | 21.06 | 4.51 | 2.01 | 4.58 |
| I1 of the invention | 8 | 0.66-0.77 | 20 | 24.9 | 0.91 | 12.39 | 51.16 | 4.01 | 21.06 | 4.51 | 2.01 | 4.58 |
| I1 of the invention | 9 | 0.78-0.89 | 20 | 29.4 | 1.07 | 12.39 | 51.16 | 4.01 | 21.06 | 4.51 | 2.01 | 4.58 |

[a]Yds: yards.
[b]Reams: one ream equals to 330 $ft^2$.
[c]Wt %: weight percent.

Example 2

Performance of Nonwoven Abrasive Tools

The nonwoven abrasive wheels of Example 1 that were 20-cm in diameter were tested for grinding SS316 metal sheets. Each of the tested wheels was mounted on the spindle of a Divine back stand grinder powered by a 3.7 Kw motor. A piece of SS316 metal sheet of about 10×5×0.1 cm was pushed against the rotating wheel at 2,700 RPM. A constant weight of 3.175 Kg was held against the SS316 metal sheet. The metal sheet was oscillating at 3 cm/second during the testing. The wheel and the metal sheet were removed from the Divine machine after each test cycle of 2 minutes in order to measure the weight loss. Each wheel was tested for a total of five cycles. The total weight losses of the wheel and the metal sheet were recorded for performance comparison. The cut was defined as the weight loss of the SS316 metal sheet and the shed was defined as the total weight loss of the test wheel. The grind ratio (g-ratio) was defined as the ratio of cut over shed. In general, it is desirable to have a product with higher cut, lower shed, and higher G-ratio. If a wheel failed prematurely and was unable to complete the test cycles, then the total test time was recorded. The wheel life was reported as the time in minutes that the wheel endured the testing. This is especially important for wheels of low densities, such as density 6.

The wheels were designated with arbitrary density numbers such as 9, 8, 7, and 6. Table 5 below shows the correlation of density number with the actual wheel densities.

TABLE 5

Density Designation

| Density Designation | Actual Density, grams/$cm^3$ |
|---|---|
| 6 | 0.44-0.55 |
| 7 | 0.55-0.66 |

TABLE 5-continued

Density Designation

| Density Designation | Actual Density, grams/$cm^3$ |
|---|---|
| 8 | 0.66-0.77 |
| 9 | 0.78-0.89 |

Performance of the nonwoven abrasive wheels of the invention, I1 series, having various densities were compared with control nonwoven abrasive wheels, control A and control B series, as summarized in Tables 6-8. As shown in Tables 6-8, the nonwoven abrasive wheels of the invention, I1 series, which were prepared by the methods of the invention utilizing a polyurethane adhesive composition that includes a non-blocked polyurethane prepolymer, Vibrathane 8020, and a phenoxy resin, Phenoxy PKHS-40, showed superior performance as compared with the control wheels, control A and control B series. In particular, Cut rates and G-ratios of the nonwoven abrasive wheels of the invention, I1 series, outperformed those of the control wheels, control A and control B series. Also, the wheels of the invention generally have a longer product life than that of the control wheels. For example, as shown in Table 8, while most of the control wheels did not complete the 10-minute test cycle as shown in the column of "Life, minutes", all the I1 wheels of the invention completed the 10-minute test cycle.

TABLE 6

Comparison of Performance of the Nonwoven Abrasive Wheels of Example 1 Having Density 9 and diameter 20 cm.

| Type | Cut (grams) | Shed (grams) | G-Ratio |
|---|---|---|---|
| Control A | 1.27-7.45 | 33.42-103.08 | 0.038-0.184 |
| Control B | 4.81-11.51 | 24.96-71.13 | 0.107-0.564 |
| I1 of the invention | 8.56-12.54 | 13.79-82.94 | 0.147-0.694 |

TABLE 7

Comparison of Performance of the Nonwoven Abrasive Wheels of Example 1 Having Density 7 and diameter 15 cm.

| Type | Cut (grams) | Shed (grams) | G-Ratio |
|---|---|---|---|
| Control A | 1.67-11.36 | 21.91-231.89 | 0.009-0.378 |
| Control B | 1.98-12.03 | 19.69-208.86 | 0.010-0.389 |
| I1 of the invention | 6.10-11.42 | 15.29-172.80 | 0.051-0.582 |

TABLE 8

Comparison of Performance of the Nonwoven Abrasive Wheels of Example 1 Having Density 6 and diameter 15 cm.

| Type | Cut (grams) | Shed (grams) | G-Ratio | Life, minutes |
|---|---|---|---|---|
| Control A | 0.22-8.53 | 59.49-209.26 | 0.002-0.126 | 0.3-10.0 |
| Control B | 1.00-9.19 | 61.86-210.12 | 0.007-0.144 | 1.25-10.0 |
| I1 of the invention | 4.14-7.63 | 132.7-162.80 | 0.030-0.060 | 10.0 |

Also, performance of the nonwoven abrasive wheels of the invention, I2, I3 and I4 series, having various densities were compared with control nonwoven abrasive wheels, control C, control D and control E series, as summarized in Tables 9 and 10. As shown in Table 9, the nonwoven abrasive wheels of the invention, I2 series, showed superior performance as compared with the control wheels, control C series, in the cut rates and G-ratios. As shown in Table 10, the nonwoven abrasive wheels of the invention, I3 and I4 series, outperformed the control wheels, control D and control E series, in the cut rates and G-ratios.

TABLE 9

Comparison of Performance of the Nonwoven Abrasive Wheels of Example 1 Having Density 9 and diameter 20 cm.

| Type | Cut (grams) | Shed (grams) | G-Ratio |
|---|---|---|---|
| Control C | 4.29-5.33 | 45.79-53.06 | 0.094-0.100 |
| I2 of the invention | 10.28-10.68 | 19.75-20.23 | 0.519-0.528 |

TABLE 10

Comparison of Performance of the Nonwoven Abrasive Wheels of Example 1 Having Density 9 and diameter 20 cm.

| Type | Cut (grams) | Shed (grams) | G-Ratio |
|---|---|---|---|
| Control D | 3.65-4.09 | 45.79-53.06 | 0.094-0.100 |
| Control E | 8.19-8.98 | 23.96-28.34 | 0.289-0.375 |
| I3 of the invention | 10.28-10.68 | 19.75-20.23 | 0.519-0.528 |
| I4 of the invention | 9.39-10.25 | 18.68-27.38 | 0.377-0.549 |

EQUIVALENTS

While this invention has been particularly shown and described with references to preferred embodiments thereof, it will be understood by those skilled in the art that various changes in form and details may be made therein without departing from the scope of the invention encompassed by the appended claims.

What is claimed is:

1. A method of preparing a coated abrasive tool, comprising the steps of:

a) combining a prepolymer having a free isocyanate content selected from the group consisting of polyester-based isophoronediisocyanate (IPDI), polyester-based toluene diisocyanate (TDI), polyether-based IPDI, polyether-based TDI, polyether-polyester-based IPDI, polyether-polyester-based TDI, and mixtures thereof and a polymeric polyol to thereby form a polyurethane adhesive composition; wherein the prepolymer and polymeric polyol are present in a ratio of between about 20:1 and about 3:1 by weight;

b) applying the polyurethane adhesive composition over a substrate to thereby form a polyurethane-adhesive-composition-coated substrate;

c) curing the polyurethane-adhesive-composition-coated substrate to thereby form a polyurethane-adhesive-coated substrate; and d) applying an abrasive material over the substrate at a time selected from the group consisting of prior to, after, and simultaneously with, the application of the polyurethane adhesive composition to the substrate, to thereby form the coated abrasive tool.

2. The method of claim 1, wherein the initial viscosity of the polyurethane adhesive composition increases by less than about 50% of the initial viscosity for a period of time in a range of between about 1 hour and about 4 hours.

3. The method of claim 2, wherein the initial viscosity of the polyurethane adhesive composition increases by less than about 50% of the initial viscosity for a period of time in a range of between about 1 hour and about 2 hours.

4. The method of claim 2, wherein the initial viscosity is in a range of between about 1,500 cps and about 5,000 cps.

5. The method of claim 1, wherein the polymeric polyol is a phenoxy resin.

6. The method of claim 2, wherein the polymeric polyol is a phenoxy resin.

7. The method of claim 1, wherein the substrate is a nonwoven substrate.

8. The method of claim 1, wherein the abrasive material is applied over the substrate simultaneously with the polyurethane adhesive composition.

9. The method of claim 1, wherein the abrasive material is applied over the polyurethane-adhesive-coated substrate.

10. The method of claim 1, wherein the abrasive material is applied prior to the application of the polyurethane adhesive composition to the substrate.

11. The method of claim 1, wherein the abrasive material is at least partially coated with an organosilicon compound.

12. The method of claim 1, wherein the polyurethane-adhesive-composition-coated substrate is cured by exposure to heat at a temperature in a range of between about 100° C. and about 250° C.

13. The method of claim 12, wherein the polyurethane-adhesive-composition-coated substrate is heated at a temperature in a range of between about 100° C. and about 150° C.

14. The method of claim 1, wherein the polyurethane-adhesive-composition-coated substrate is cured by exposure to a microwave radiation energy.

15. A coated abrasive tool, comprising:

a) a substrate;

b) a polyurethane adhesive resin coating over the substrate, the resin coating being formed from a polymerization reaction of a phenoxy resin with a prepolymer having a free isocyanate content selected from the group consisting of polyester-based isophoronediisocyanate (IPDI), polyester-based toluene diisocyanate (TDI), polyether-based IPDI, polyether-based TDI, polyether-polyester-based MDI, polyether-polyester-based TDI, and mixtures thereof; wherein the prepolymer and polymeric polyol are present in a ratio of between about 20:1 and about 3:1 by weight; and c) an abrasive material over the substrate.

16. The coated abrasive tool of claim 15, wherein the substrate is a nonwoven substrate.

17. The coated abrasive tool of claim 15, wherein the abrasive material is within the polyurethane adhesive resin coating.

18. The coated abrasive tool of claim 15, wherein the abrasive material is over the polyurethane adhesive resin coating.

19. The coated abrasive tool of claim 15, wherein the abrasive material is under the polyurethane adhesive resin coating.

20. The coated abrasive tool of claim 15, further including a supersize layer that includes at least one agent selected from the group consisting of a lubricant, an anti-static agent and an anti-loading agent.

* * * * *